United States Patent [19]

Wolfanger

[11] Patent Number: 4,768,255

[45] Date of Patent: Sep. 6, 1988

[54] CHIMNEY CLEANING DEVICE

[76] Inventor: Louis N. Wolfanger, 404 Second Ave., Wayland, N.Y. 14572

[21] Appl. No.: 72,671

[22] Filed: Jul. 13, 1987

[51] Int. Cl.[4] ..... F23J 3/02

[52] U.S. Cl. ..... 15/243; 15/163

[58] Field of Search ..... 15/242, 243, 249, 162, 15/163, 104.16–104.19

[56] References Cited

U.S. PATENT DOCUMENTS

| | | | |
|---|---|---|---|
| D. 282,111 | 1/1986 | Obenchain | D32/35 |
| 1,110,856 | 9/1914 | Anderson | 15/243 |
| 1,184,784 | 5/1916 | Steiner | 15/249 |
| 1,500,886 | 7/1924 | Nelson | 15/243 |
| 1,847,364 | 3/1932 | Rugard | 15/163 |
| 2,077,731 | 4/1937 | Aaby | 15/243 |
| 2,173,606 | 9/1939 | Forster | 15/104.18 |
| 2,636,202 | 4/1953 | Hinzman | 15/104.18 X |
| 4,085,477 | 4/1978 | Anderson | 15/243 |
| 4,090,271 | 5/1978 | Ploutkowski | 15/243 |
| 4,208,756 | 6/1980 | Smith | 15/243 |
| 4,254,528 | 3/1981 | Souliere | 15/163 |
| 4,319,378 | 3/1982 | Bowman et al. | 15/162 |
| 4,333,200 | 6/1982 | Thurow | 15/243 |
| 4,365,381 | 12/1982 | Neuman | 15/243 |
| 4,365,382 | 12/1982 | Korfmann | 15/249 |
| 4,433,449 | 2/1984 | Rainey | 15/243 |
| 4,490,879 | 1/1985 | Colby | 15/242 |
| 4,492,000 | 1/1985 | Skogen | 15/242 |
| 4,562,608 | 1/1986 | Weir | 15/163 |
| 4,657,597 | 4/1987 | Wolf et al. | 134/8 |

FOREIGN PATENT DOCUMENTS

| | | | |
|---|---|---|---|
| 508709 | 1/1955 | Canada | 15/162 |

*Primary Examiner*—Peter Feldman

*Attorney, Agent, or Firm*—Marjama & Pincelli

[57] ABSTRACT

A device for cleaning a chimney flue having four side walls which comprises a rigid enlongated shaft, a fixed mounting plate means attached at one end of said elongated shaft, four scraping blades attached to said mounting plate means so as to collectively define a substantially rectangular or square perimeter, each of said blades having a scraping end and a fixed end pivotably attached to said mounting plate means remote from said scraping end, and means attached to said shaft within said perimeter for expanding and contracting said blades to permit cleaning of said four side walls of said flue at the same time.

2 Claims, 5 Drawing Sheets

CHIMNEY CLEANING DEVICE

BACKGROUND OF THE INVENTION

This invention relates to a cleaning device and more particularly to a cleaning device for removing creosote and other deposits from the internal walls of a chimney flue.

It is well recognized that for purposes of fire safety and efficiency in wood burning stoves and fire places that the chimney flue should be cleaned regularly to remove creosotes and other unwanted deposits which build up on the inside of the flue wall.

Generally, flues are cleaned with metal brushes and in some cases metal objects like a chain affixed to the end of a cable or rope. Cleaning, by these techniques, however, although removing the creosote deposits from the wall of the flue do not provide a highly efficient method of cleaning. This is due to the fact that these techniques do not permit a sufficient force to be applied against a chimney flue wall to enable efficient removal of creosote deposits.

In order to avoid the above deficiency of said flue cleaning methods, various devices have been devised over the years in order to attempt to exert more force and pressure against the side of the flue wall in order to clean chimney flues more efficiently and effectively.

U.S. Pat. Nos. 1,110,856; 1,184,784; 1,500,886; 4,254,528; and 4,490,879 illustrate various devices for cleaning chimney flues which have been devised over the years. These devices, however, suffer from various deficiencies such requiring the device to be suspended from a cable or rope in which case no effective scraping force can be applied to the chimney wall, or in other cases are designed so that only two surfaces of the wall are cleaned at the same time requiring a duplicate effort to be required in order to clean the remaining two walls of a square or rectangular chimney flue. In addition, the prior art suffers from the requirement that any adjustment regarding the size of the cleaning device, and hence force applied against the flue wall, be made before placing the device inside the chimney to clean the flue wall. Therefore, in operation, when an adjustment is required regarding the size of the chimney cleaning device, it must be removed from the flue and readjusted prior to continuing the cleaning operation. These prior art devices also suffer from the disadvantage of being easily susceptible to becoming lodged inside the chimney flue.

OBJECTS OF THE INVENTION

It is therefore an object of the present invention to provide a chimney cleaning device that will effectively and efficiently remove creosote and other deposits from a chimney flue.

It is a further object of the present invention to provide a chimney cleaning device which will simultaneously clean all four walls of a rectangular or square chimney flue and not become lodged inside the flue.

It is a further object of the present invention to provide a chimney cleaning device which may be adjusted as to size to control the force applied against the inside of the flue while in use within the chimney flue.

SUMMARY OF THE INVENTION

The above objects and others are accomplished in accordance with the present invention which comprises a novel chimney cleaning device. The chimney cleaning device of the present invention comprises four cleaning blades which define a rectangular or square perimeter which is sized to clean a rectangular or square chimney flue. The device is adapted to clean all four sides of a chimney flue simultaneously and is constructed such that the cleaning blades can be adjusted during cleaning so that the cleaner will never become lodged inside the chimney. This is accomplished by using a moveable plate assembly which is attached to the bottom inside edges of the cleaning blades, and expands or contracts the perimeter formed by the scraping edges of the blades as the assembly is moved up or down on a threaded center shaft when the shaft is rotated from above the chimney by a person operating the device. Preferably the shaft is provided with interconnecting means which can be fitted together to increase the length of the shaft to allow the device to clean any length of chimney.

DETAILED DESCRIPTION OF THE INVENTION

Figure 1:
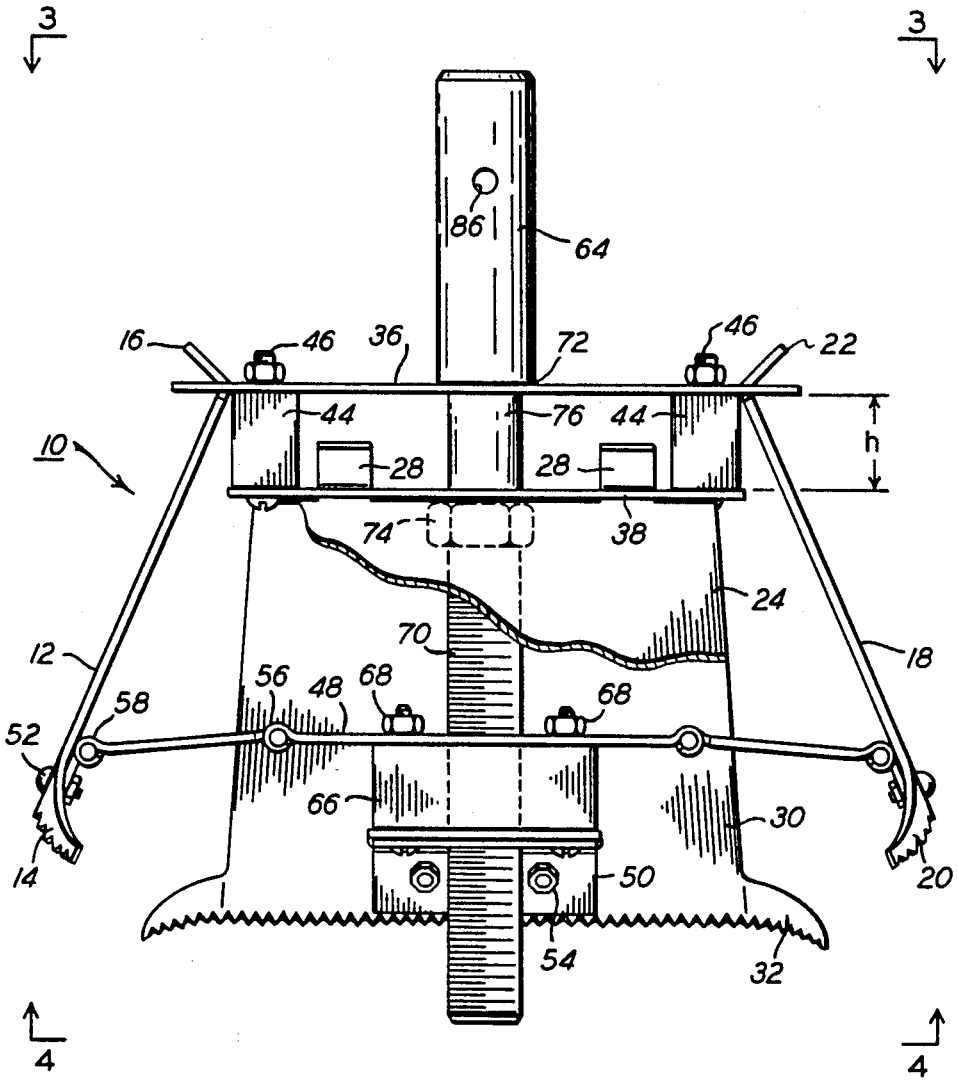
FIG. 1 illustrates a partially cut-away side view of one embodiment of a device of the present invention in the open or expanded position.

The device of the present invention is illustrated in FIG. 1 by reference character 10. The device 10 comprises four scraping blades 12, 18, 24 and 30 each having a scraping end 14, 20, 26 and 32, respectively, which is preferably serrated, and a fixed pivotal end containing connecting tabs 16, 22, 28 and 34, respectively (see FIGS. 1, 3 and 4). In FIG. 1 blade 24 is partially cut away in order to more completely show the internal structure of the device. The four blades are attached by pairs to fixed mounting plate means which comprise respective upper and lower mounting plates 36 and 38 in a pivotal manner by a pair of tabs 16, 22, 28 and 34 respectively, on each blade, which pass through a pair of slots 40 and 42—at one edge of each associated mounting plate (see FIGS. 1 and 3). The tabs may be bent prior to assembly or bent over after insertion into the slots. Mounting plates 36 and 38 are separated by spacers 44 and held in placed with bolts fastening means such as 46.

Figure 2:
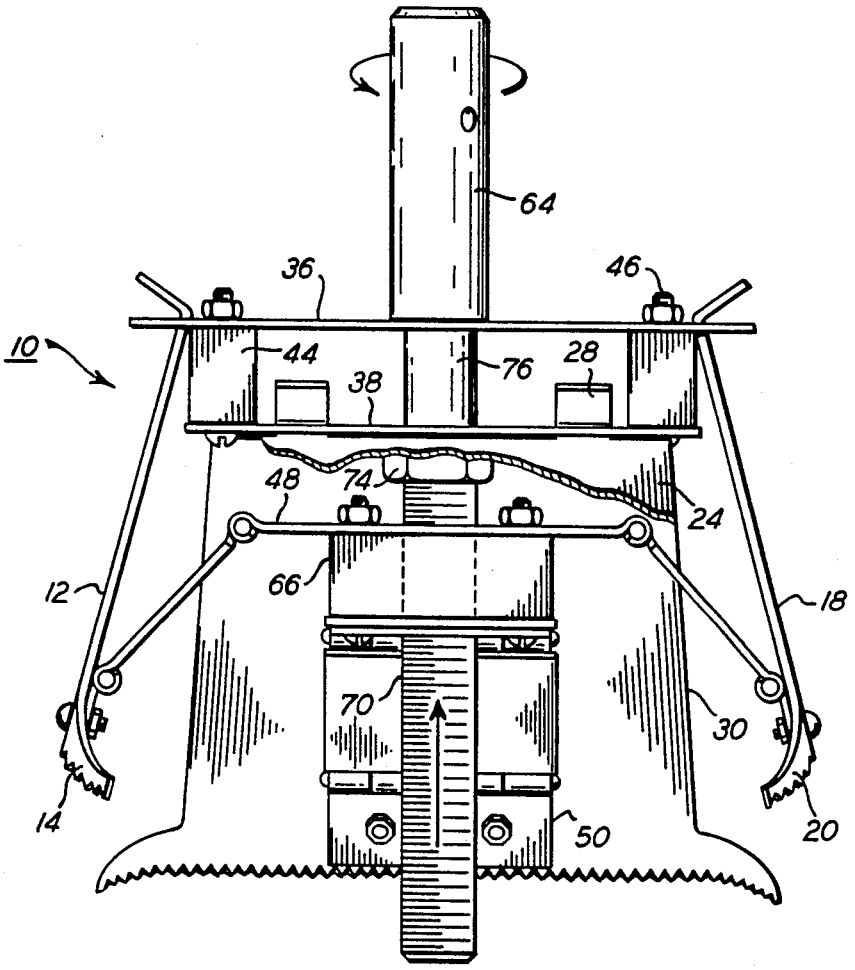
FIG. 2 illustrates a partially cut-away side view of the device of FIG. 1 in the closed or contracted position.

Two pair of oppositely disposed hinge members 48 and 50 are attached respectively to opposite pairs of the blades 12 and 18 and 24 and 30 near their scraping end by bolts 52 and 54, respectively. The hinge members 48 and 50 are hinged at two locations 56 and 58; and 60 and 62; respectively, to allow for proper movement of the four scraping blades. The hinge members preferably comprise two steel plates which are crossed at right angles and centrally connected together by shaft 64 through a hole in each hinge member at opposite sides of a centrally located moveable assembly plate 66. Preferably the thicknesses h of spacers 44 and moveable assembly plate assembly 66 are made substantially equal in order to provide the proper clearance needed for the in (closing) and out (opening) movement of the scraping blades. Also, by making both pairs of blades the same size will permit mass production of the various parts to a uniform size to lower production costs. The hinge members are fixed to moveable assembly plate 66 by fastening means such as bolts 68. Moveable assembly plate 66 is threaded to mate with the threaded portion 70 of shaft 64. The rigid steel plates which are double hinged, allow for expansion (opening) or contraction (closing) of the scraping blades when the plate assembly 66 is moved up or down the threaded shaft. Rotation of shaft 64 allows for movement of plate assembly 66 up or down the threaded portion 70 of the shaft and thus controls the movement of the hinges as illustrated by a comparison of FIGS. 1 and 2. In FIG. 1 the blades are in the open or expanded position is caused by rotation of the shaft clockwise. When the shaft is rotated counter clockwise as illustrated in FIG. 2, the blades will close or contract due to the movement of the hinge members as the moveable plate assembly 66 along with the hinge members travel up the threaded portion of the shaft. Preferably the threaded portion of shaft 64 will have left hand threads to provide proper movement of plate assembly 66 when shaft 64 is rotated clockwise or counter clockwise.

The diameter of shaft 64 is reduced at one end 72 to provide a collar 72 which acts as a stop surface against the upper surface of plate 36. The collar 72 in conjunction with stop nut 74 functions upon rotation of shaft 64 to keep mounting plates 36 and 38 and the shaft in place longitudinally while allowing the hinge members and moveable plate assembly 66 to move up and down on the threaded portion of shaft 64 in response to rotation of the shaft. The rotation of the shaft allows for movement of the hinge member inwardly and outwardly in order to adjust the contact of the scraping edges of the four blades against the inside wall of a flue during the scraping operation.

In order to allow for movement of the scraping blades inwardly and outwardly without contacting each other, one pair of oppositely disposed scraping blades are offset or disposed at a higher plane than said other pair of oppositely disposed scraping blades. For example, as shown in FIG. 1, the scraping end portion of 14 and 20 of blades 12 and 18 respectively, is at a plane higher than the pair of blades 24 and 30 and their scraping edges 26 and 32. As further shown in FIG. 1, the scraping device of the present invention is illustrated in the expanded or open position. As illustrated in FIG. 2, by rotation of shaft 64, the moveable plate assembly 66 along with the attached hinge members has traveled up the threaded shaft, and the scraper blades are in the contracted or closed position.

Figure 3:
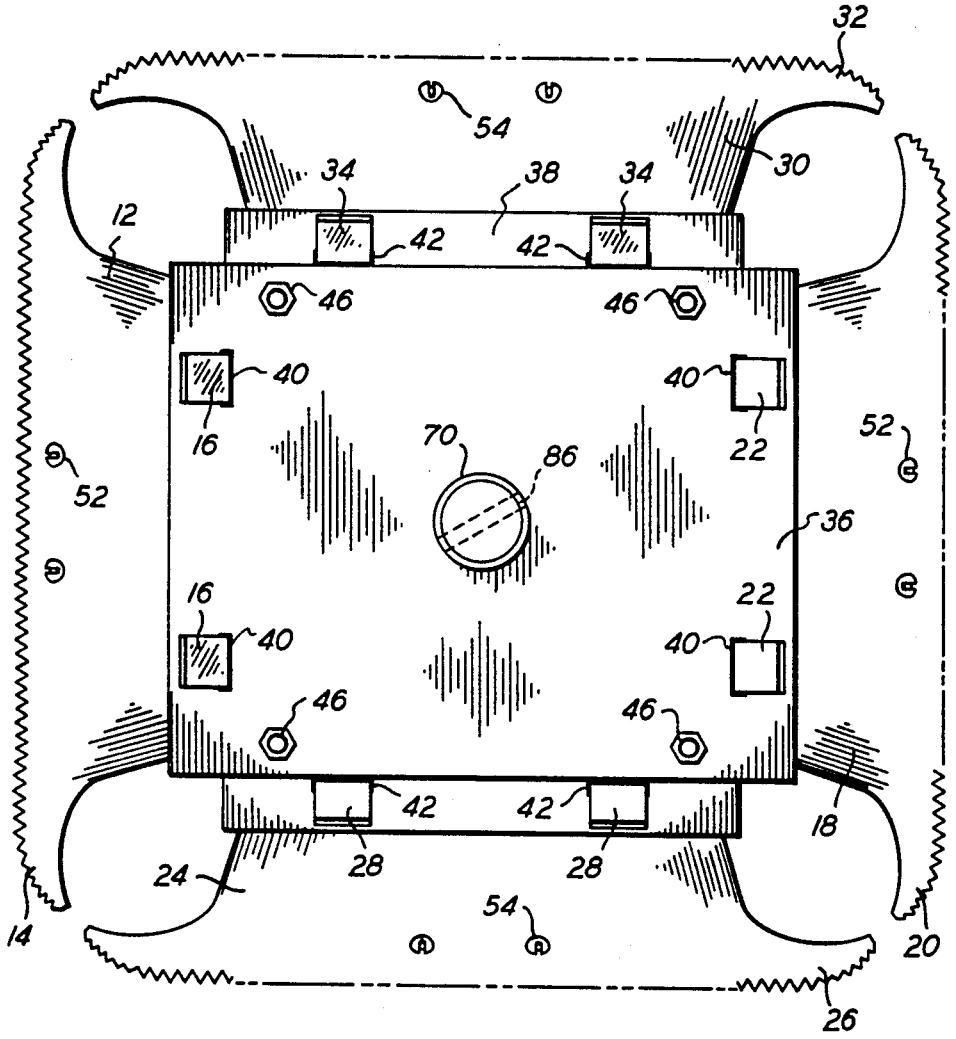
FIG. 3 illustrates a top view of the device of FIG. 1.

FIG. 3 illustrates a top view of the present invention in which the top edge of each scraping blade is pivotably attached to top mounting plate 36 and bottom mounting plate 38 respectively through tabed portions of each blade which are contained in slots 40 and 42 in plates 36 and 38, respectively.

Figure 4:
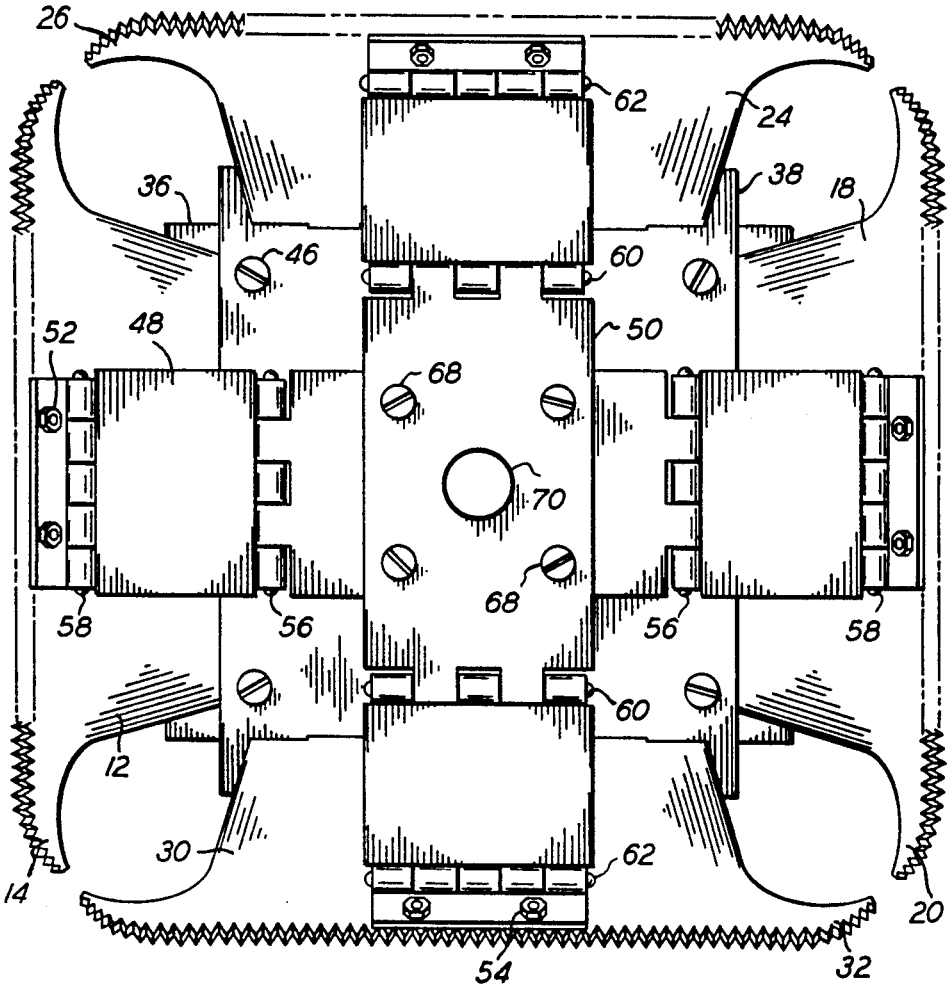
FIG. 4 illustrates a bottom view of the device of FIG. 1.

FIG. 4 illustrates a bottom view of a device of the present invention showing the oppositely disposed scraping blades in two different planes attached respectively to mounting plates 36 and 38. In general it is preferred that the components of the device of the present invention such as the scraping blades, plates, shaft, etc. be made of a metal such as steel or an aluminum alloy. Some components such as spacers could be made of other materials such as a durable plastic.

For purposes of illustration, the device described herein is square in cross-section and hence adapted to clean a chimney flue having a square cross-section. When rectangular chimney flues are to be cleaned, the device of the present invention is modified accordingly. To change the device from a square to rectangular configuration, the dimension of one of the mounting plates is changed to the appropriate rectangular dimension, and the width of one pair of scraping blades is increased to accommodate the increased dimension of the associated mounting plate. Similarly, the length of the hinge member associated with the increased dimension of the mounting plate is increased accordingly.

Figure 5:
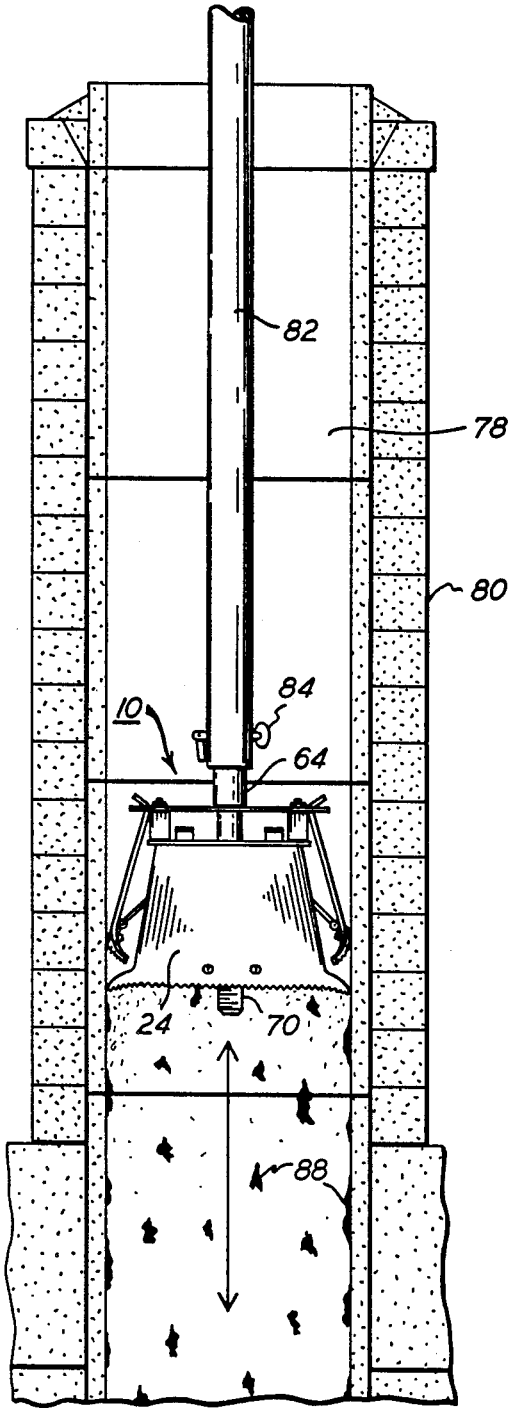
FIG. 5 illustrates a schematic view of the device of the present invention in use within a chimney flue.

FIG. 5 is a schematic illustration of a device of the present invention in operation inside the flue 78 of a chimney 80. The device is suspended on a handle 82 which is connected to shaft 64 with a key 84 which passes through hole 86 in the shaft. In operation, the device is contracted or closed through rotation of the shaft through the handle, and inserted into the chimney. The size of the perimeter of the four blades is then expanded by rotation of the shaft in the opposite direction to make contact with the inside surfaces of said flue. The device is then moved up and down in contact with the four side walls simultaneously to remove creosote and other debris 88 from the walls of the flue. If the device becomes stuck within the chimney or is moved along portions within the flue where direct contact by the scraping blades is not apparent, any size adjustment is readily made through rotation of shaft and hence the change in size of the perimeter formed by the scraping blades in order that snug contact be maintained between the scraping blades and the four walls of the flue.

The device is assembled and used as follows:

The threaded portion of the center shaft is inserted through the holes in mounting plates 36 and 38 until it rests against collar 72. Stop nut 74 is screwed onto the shaft so that the assembly formed by the mounting plates can rotate freely on the smooth portion 76 of the shaft. The moveable plate assembly 66 with the central portion of the hinge members attached is then screwed part way onto the center shaft. The tabs of each cleaning blade are then inserted into the proper slots in their respective mounting plates to fix the upper portion of the blades in place. The hinges members are attached to the bottom portion of the cleaning blades by bolts in such a way that one set of opposing blades are offset a distance vertically to the other set of opposing blades to allow the lower portion of the cleaning blades to be expanded or contracted without contacting each other. The square or rectangular shape of the chimney liner acts like a wrench for the chimney cleaner, to prevent it from rotating when the center shaft is rotated. This allows the moveable assembly plate and associated hinge members to be moved up or down on the threaded center shaft when the shaft is rotated, thereby moving the scraping end of the blades in or out. Rotating the shaft clockwise will force the blades against the chimney liner and rotating the shaft counter clockwise will loosen the blades. Then by moving the chimney cleaner up and down inside the chimney the creosote will be scraped off the chimney liner. As illustrated by FIG. 5, the center shaft is bolted or otherwise attached to a length of pipe to form a handle. More pipe may be added as needed to clean any length chimney.

Although particular embodiments of the present invention have been disclosed herein for purposes of explanation, further modifications or variations thereof will be apparent to those skilled in the art to which this invention pertains.

I claim:

1. A device for cleaning a chimney flue having four side walls comprising:

a rigid elongated shaft, a fixed mounting plate means attached at one end of said elongated shaft, four scraping blades attached to said mounting plate so as to collectively define a substantially rectangular or square perimeter, each of said blades having a scraping end and a fixed end pivotably attached to said mounting plate means remote from said scraping end, with one pair of oppositely disposed scraping blades being attached to said mounting plate means at a different level than said other pair of blades such that the scraping edges are at a different plane than the scraping edges of said other oppositely disposed pair of blades, and means attached to said shaft within said perimeter for expanding and contracting said blades to permit cleaning of said four side walls of said flue at the same time, said means including two pairs of hinge members, each pair of which are attached to the bottom edge of oppositely disposed scraping blades, with both pair of hinge members being centrally attached to a moveable member which is in threaded engagement with the end of said shaft opposite said mounting plate which allows for movement of said hinge members in response to the rotation of said shaft.

2. The device of claim 1 in which the ends of the edges of said blades are curved so as to allow said device to clean the curved corners of a flue.

* * * * *